US010877419B2

(12) United States Patent
Mashiach et al.

(10) Patent No.: US 10,877,419 B2
(45) Date of Patent: Dec. 29, 2020

(54) IN-LINE PRINTING CALIBRATION

(71) Applicant: HP Indigo B.V., Amstelveen (NL)

(72) Inventors: On Mashiach, Ness Ziona (IL); Yoav Landau, Ness Ziona (IL)

(73) Assignee: HP INDIGO B.V., Amstelveen (NL)

( * ) Notice: Subject to any disclaimer, the term of this patent is extended or adjusted under 35 U.S.C. 154(b) by 0 days.

(21) Appl. No.: 16/617,543

(22) PCT Filed: Jun. 30, 2017

(86) PCT No.: PCT/EP2017/066273

§ 371 (c)(1),
(2) Date: Nov. 27, 2019

(87) PCT Pub. No.: WO2019/001727

PCT Pub. Date: Jan. 3, 2019

(65) Prior Publication Data

US 2020/0180324 A1 Jun. 11, 2020

(51) Int. Cl.

| | |
|---|---|
| ***G03G 15/00*** | (2006.01) |
| ***B41J 29/393*** | (2006.01) |
| ***B41J 2/045*** | (2006.01) |

(52) U.S. Cl.

CPC ..... *G03G 15/5062* (2013.01); *B41J 2/04518* (2013.01); *B41J 29/393* (2013.01); *B41J 2029/3935* (2013.01); *G03G 2215/00021* (2013.01); *G03G 2215/00569* (2013.01)

(58) Field of Classification Search

CPC ..... B41J 29/393; B41J 2029/3935; G03G 15/5062; G03G 2215/00569

See application file for complete search history.

(56) References Cited

U.S. PATENT DOCUMENTS

| | | | | |
|---|---|---|---|---|
| 4,273,045 | A | 6/1981 | Crowley | |
| 6,317,147 | B1 | 11/2001 | Tanaka | |
| 8,045,218 | B2 | 10/2011 | Qiao et al. | |
| 8,559,050 | B2 | 10/2013 | Conlon et al. | |
| 8,607,102 | B2 | 12/2013 | Sampath et al. | |
| 2003/0112283 | A1* | 6/2003 | Ward | B41J 29/393 347/5 |
| 2005/0134874 | A1 | 6/2005 | Overall et al. | |

(Continued)

FOREIGN PATENT DOCUMENTS

| | | |
|---|---|---|
| EP | 0856402 | 8/1998 |
| EP | 2522515 | 11/2012 |

OTHER PUBLICATIONS

Kaji, M et al, "Max Diamond Eye In-line Quality Control System without Color Bar for Commercial Web Offset Press." Mitsubishi Heavy Industries Technical Review 46, No. 1 (2009): 48.

(Continued)

*Primary Examiner* — Julian D Huffman

(74) *Attorney, Agent, or Firm* — HP Inc. Patent Department

(57) ABSTRACT

In one example of the disclosure, a first print engine is caused to print a first image in a first set of sectors of a substrate. A second print engine is caused to print a second image in a second set of sectors of the substrate. The second print engine is caused to print a cover-up image over an incidence of the first image printed by the first print engine. The second print engine is caused to print a calibration image upon the cover-up image.

15 Claims, 7 Drawing Sheets

(56) References Cited

U.S. PATENT DOCUMENTS

| | | | | |
|---|---|---|---|---|
| 2008/0030787 | A1 | 2/2008 | McElvain | |
| 2010/0060682 | A1 * | 3/2010 | Akatsuka | B41J 2/2114 347/9 |
| 2011/0205568 | A1 | 8/2011 | Moalem et al. | |

OTHER PUBLICATIONS

Prinect Color Workflow: Color and Quality Management for Any Business Model, Jan. 30, 2013, Available at: <https://www.heidelberg.com/global/media/en/global_media/products__prinect_topics/pdf_1/colorworkflow.pdf.

* cited by examiner

IN-LINE PRINTING CALIBRATION

BACKGROUND

A print system may apply print agents to a paper or another substrate to produce an image on the substrate. One example of a print system is a web-fed print system, which applies the print agents to a web substrate fed to the print system by a substrate roll feeder system. In an example, a feeder system, sometimes referred to as unwinder, may feed a continuous web substrate to the print system. After application of the print agents, the printed upon substrate may be collected on a re-winder drum or cut into sheets. In certain examples, web-fed print systems may apply a print agent that is an electrostatic printing fluid (e.g., electrostatically chargeable toner or resin colorant particles dispersed or suspended in a carrier fluid). In other examples, the print agent may be applied via inkjet or dry toner printing technologies.

DRAWINGS

DETAILED DESCRIPTION

Figure 1:
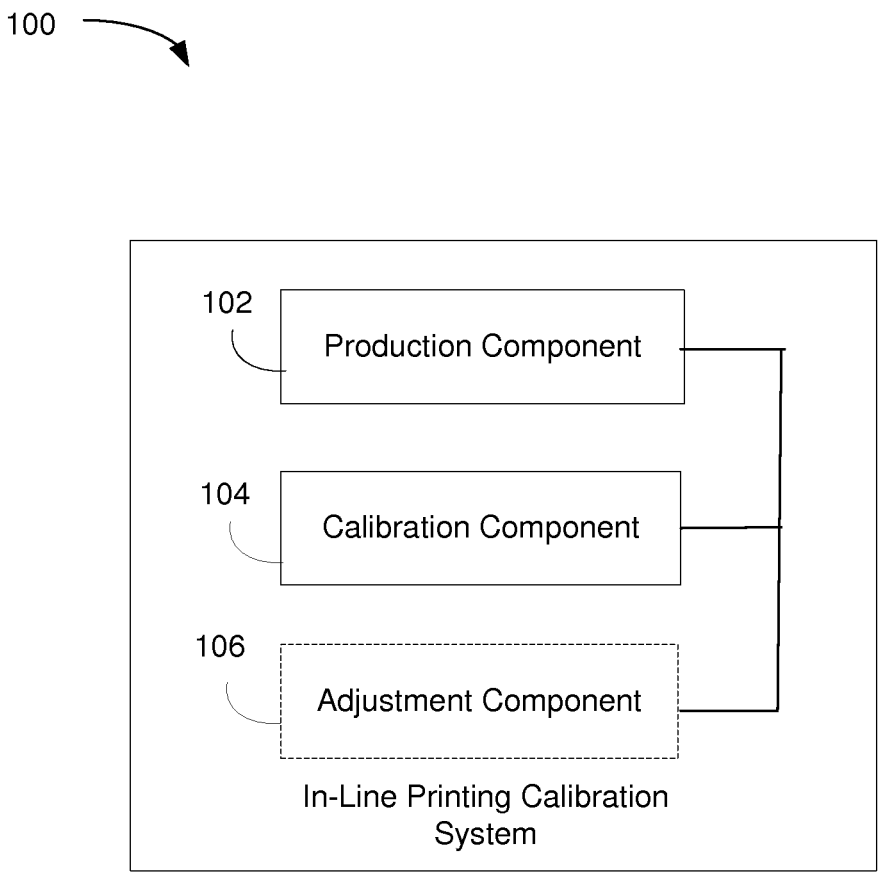
FIG. 1 illustrates an example of a system for in-line printing calibration.

Certain print systems have increased printing efficiency and speed by employing multiple in-line print engines simultaneously to create a print job. In an example, such a print system may include a first print engine and a second print engine that is situated in-line downstream to the first print engine. The first print engine may print alternating pages of a print job, e.g., page 1, page 3, page 5, etc. sequentially on the web, leaving blank spaces on the web for page 2, page 4, page 6, etc. After page 1, page 3, page 5, etc. are formed on the web by the first engine, the substrate web passes under the second print engine that prints alternating pages between those already printed, e.g., page 2, page 4, page 6, etc. Printing times are reduced as while the second print engine is printing, e.g. page 2, page 4, page 6, etc., the first print engine can be simultaneously printing new pages, e.g., page 7, page 9, page 11, etc.

With current in-line multiple engine print systems an operator may regularly perform a calibration operation. If the calibration operation is for a second engine downstream of a first engine, any printed substrate between the first and second engines is advanced to a point beyond the second print engine in order that a calibration image can be printed on a blank portion of the substrate. In some cases where there is a web substrate, such a calibration operation may result in the advancing and disposal of up to 20 meters of web substrate that was previously printed upon by the first print engine. As certain substrates, e.g., synthetic substrates for industrial printing, can be expensive, such wasted media can significantly affect project pricing and customer satisfaction with the print system.

To address these issues, various examples described in more detail below provide an in-line printing calibration system and method that enables a calibration for a second print engine upstream of a first print engine, without a need to advance and dispose of meters of printed upon web substrate that is situated between the first and second engines at the time for calibration. In an example, a print system includes a first print engine and an in-line second print engine situated in-line to one another relative to a web substrate. The first and second print engines are caused to operate in a production mode, wherein the first engine is to print a first image in a first set of sectors of a substrate, and the second print engine is to print a second image in a second set of sectors of the substrate. In the production mode the first print engine may be printing a first image and the second print engine may be printing a second image contemporaneously. In certain examples, the result is that the first image printed by the first print engine in the first set of sectors and the second image printed in the second set of sectors may be adjacent to one another.

The in-line print system may also operate in a calibration mode, wherein the second print engine is to print a cover-up image over an incidence of the first image printed by the first print engine, and is to print a calibration image upon the cover-up image. In certain examples, the in-line print system may cause the second print engine to print the cover-up image and the calibration image over the previously printed first image responsive to having determined that a portion of the substrate situated between the first and second print engines has been printed upon by the first print engine. In certain examples, the in-line print system may include an optical scanner or other sensor and utilize the sensor to identify the calibration image. The in-line print system may cause a calibration adjustment to be made at the in-line print system based upon such identification of the calibration image.

In this manner users of the disclosed in-line print system should appreciate the substantial cost savings and environmental benefits as compared to systems that would advance and dispose of media that was printed upon and situated between print engines at the time of commencement of the calibration. Further, manufacturers and providers of print systems should likewise enjoy competitive benefits of offering the in-line print system described herein.

Figure 2:
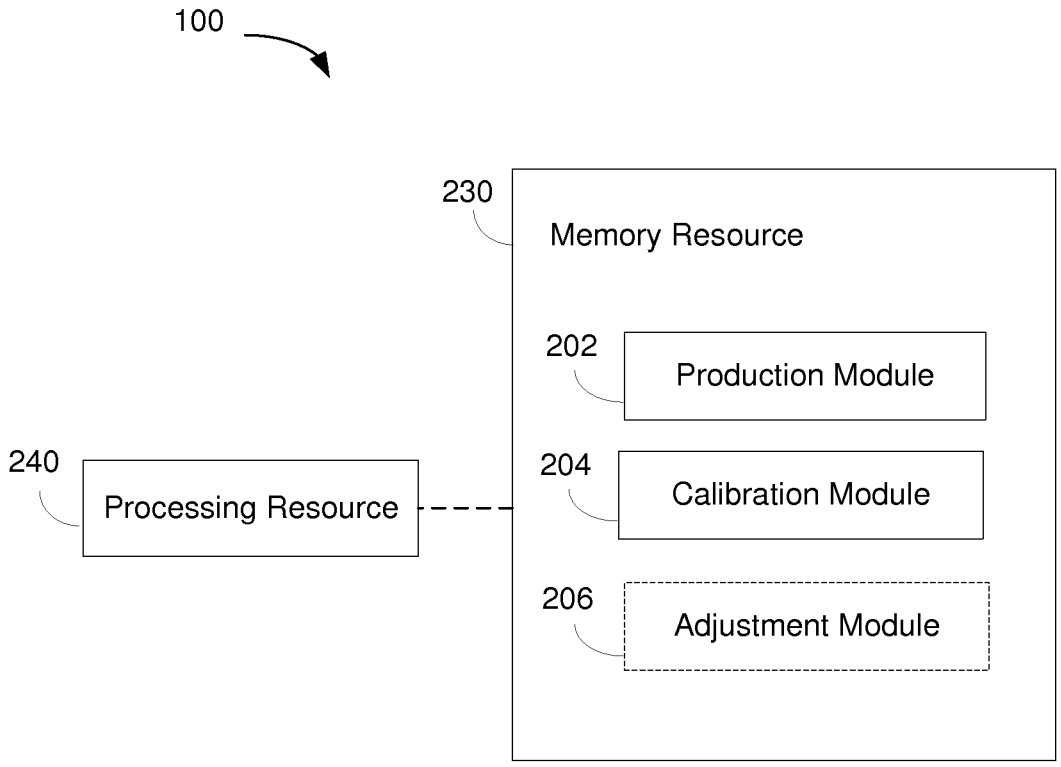
FIG. 2 is a block diagram depicting a memory resource and a processing resource to implement an example of a method of in-line printing calibration.

FIGS. 1 and 2 depict examples of physical and logical components for implementing various examples. In FIG. 1 various components are identified as components 102, 104, and 106. In describing components 102-106 focus is on each component's designated function. However, the term component, as used herein, refers generally to hardware and/or programming to perform a designated function. As is illustrated with respect to FIG. 2, the hardware of each component, for example, may include one or both of a processor and a memory, while the programming may be code stored on that memory and executable by the processor to perform the designated function.

FIG. 1 illustrates an example of a system 100 for in-line printing calibration. In this example, system 100 includes a production component 102, a calibration component 104, and an adjustment component 106. In performing their respective functions, components 102-106 may access a data repository, e.g., a memory accessible to system 100 that can be used to store and retrieve data.

In an example, production component 102 represents generally a combination of hardware and programming to cause a first print engine at system 100 to print a first image in a first set of sectors of a substrate. Production component 102 is also to cause a second print engine at system 100 to print a second image in a second set of sectors of the substrate. As used herein a "print engine" refers to generally to a set of components that are utilized to apply ink or any other print agent to a substrate. The second print engine is an engine that is in-line with the first print engine. As used herein, an "in-line" print system refers generally a print system with print engines in-line to one another. As used herein, first and second print engines being "in-line" with another refers generally to the first and second print engines being situated to print in sequence or concurrently upon a common or same substrate. As used herein, the terms "downstream" and "upstream" are relative to a direction of travel of a substrate (e.g., if a web substrate a web direction, or if a sheet substrate a direction of travel of the sheet) as the substrate moves through the in-line print system. The first print engine characterizes the engine upstream relative the inline second print engine. As used herein a "sector" of a substrate refers generally to an area, portion, or subdivision of the substrate that is designated as a target for printing upon on the substrate.

In a particular example, the multiple print engine print system may be a dual print engine Liquid Electro-Photographic ("LEP") print system such as the HP Indigo 8000 press. In an example of LEP printing, the print agent application components at the print system may include a writing element, a photoconductor element, a charge element, an intermediate transfer member or blanket (hereinafter "blanket"), and/or an impression drum. In another example, the multiple print engine print system may be an inkjet print system, and the print agent application components may include a print bar or another set or sets of thermal inkjet or piezo printheads. In another example, the multiple print engine print system may be a dry toner laser printing, and the print agent application components may include a photoconductor, dry toner cartridge, and/or a fuser element.

In certain examples of a production mode for the in-line print system, production component 102 may cause the first print engine to print the first image in the first set of sectors and the second print engine prints the second image in the second set of sectors such that after completion of printing the web includes contains a row of alternating first and second images. In other examples, production component 102 may cause the first print engine to print a first image in a first set of sectors and the second print engine to print a second image in a second set of sectors such that such that after printing the substrate includes a row of first images wherein a second image has been printed over the top of each of the first images.

Calibration component 104 represents generally a combination of hardware and programming to cause the second print engine to print a cover-up image over an incidence of the first image printed by the first print engine, and then causing the second print engine to print a calibration image upon such cover-up image. As used herein, "calibration image" refers generally to any image that has an attribute, fiducial, pattern, or other feature that can be identified by a sensor and used by a system to make a calibration adjustment a system. In some circumstances the calibration adjustment may be to set or to reset the in-line print system to a base level, tuning, or setting. In other circumstances, the calibration adjustment may be to set the in-line print system to a new level, tuning, or setting, e.g., in anticipation of an impending or desired specific use for the print system. In one example, calibration component 104 may cause the second print engine to print the cover-up image and the calibration image over the cover-up image after having received data indicative that a calibration of the second engine is due to occur, or is needed, and that a portion of the substrate situated between the first and second print engines has been printed upon by the first print engine. In another example, calibration component 104 may cause the second print engine to print the cover-up image and the calibration image over the cover-up image after calibration component 104 determines that calibration of the second engine is due to occur, or is needed, and that the a portion of the substrate situated between the first and second print engines has been printed upon by the first print engine.

In examples, calibration component 104 is to cause the second print engine to print the cover-up pattern with an optical density sufficient to enable an optical scanner to identify the calibration image. In examples, the cover-up pattern may be printed with a single ink color from a single ink cartridge or other reservoir, e.g., a white ink, a yellow ink, or any other color ink. In other examples, the cover-up pattern may be printed with a combination of inks formed from inks supplied by several ink cartridges or reservoirs. In examples, the cover-up image may be a layer of ink of uniform optical density to be applied to the substrate. In other examples, the cover-up image may be an image with varying degrees of optical density in accordance with the attributes of the image to be covered up and/or the attributes of the calibration image to be applied over the cover-up image.

In certain examples, calibration component 104 may utilize an optical scanner or other sensor to determine characteristics of the image that was printed by the first print engine and that is to be covered up with the cover-up image. In examples, calibration engine 104 may utilize such determined image characteristics to determine a sufficient optical density for the cover-up pattern, and cause the printing of the cover-up image at such sufficient optical density. For instance, calibration component 104 may determine that that n iterations of the cover up image with a subject ink (e.g., a white ink) are to be applied to the substrate to ensure sufficient cover up of the production image printed by the first print engine, and in turn cause the second print engine to make n iterations of the cover-up image upon the substrate using the subject ink.

Adjustment component 106 represents generally a combination of hardware and programming to cause a calibration adjustment at the in-line print system based upon an identification of the calibration image. In examples, an optical scanner or other sensor that is included within the second print engine can be used to identify the calibration image that was printed by the second print engine. In other examples, an optical scanner or other sensor that is situated downstream of the second print engine with respect to the substrate path can be used to identify the calibration image that was printed by the second print engine.

The calibration adjustment caused by adjustment component 106 may be any type of adjustment to the in-line print system. For instance, the calibration adjustment caused by adjustment component 106 may be an adjustment to an inline-printer registration system that measures an actual location or scaling of an image relative to a desired location or scaling. In LEP printing example, the adjustment may cause a setting or resetting of a desired location or scaling of an image upon a photoconductor element (e.g., a drum or belt with a photoconductive foil or other photoconductive surface) as a laser or other writing element selectively discharges the photoconductor to create an image upon the drum.

The adjustment may be to cause a setting or resetting of a desired location or scaling of an image upon a blanket that is to receive charged ink from a photoconductor. Alternatively, the adjustment may be to cause a setting or resetting of a desired location or scaling of an image as it is to be transferred from a blanket to a substrate.

In examples where the in-line print system utilizes printheads rather than LEP printing, the adjustment may cause a setting or resetting of a desired location or scaling of an image as the image is to be applied by nozzles of a printhead or printheads upon the substrate. In examples, the desired location or scaling adjustment may be one that is to define an image length, image width, and or repeat length for an image as it is to appear when printed upon the substrate. In examples, the calibration adjustment caused by adjustment component 106 may be an adjustment to a system that is to measure a position of the substrate relative to a component (e.g., a component of the first print engine, a component of the second print engine, or a component of a finishing device) of the in-line print system.

In other examples, the calibration adjustment caused by adjustment component 106 may be an adjustment to a system that is to measure a pressure, a relative location, and/or a timing of engagement as between components of the in-line print system. For instance, in examples of LEP printing, the calibration adjustment caused by adjustment component 106 may be an adjustment to a system that is to measure or define an amount of force or angle of engagement as between a developer unit that applies charged ink to a photoconductor element and the photoconductor element (e.g., a photoconductor drum or photoconductor belt). In other examples, the calibration adjustment caused by adjustment component 106 may be an adjustment to a system that is to measure or define an amount of force or angle of engagement as between a photoconductor element and a blanket. In another example of LEP printing, the calibration adjustment caused by adjustment component 106 may be an adjustment to a system that measures or defines an amount of force to be applied be applied or an angle of engagement as between blanket (e.g., as the blanket transfers layers of ink to the substrate to form the image upon the substrate) and a substrate (e.g., as the substrate is held in place by an impression drum, platen, or other media handling component).

It should be noted that while this disclosure frequently refers to LEP print systems, it is contemplated and intended that this disclosure also apply to calibration of any other in-line print system. Such other print systems may include, but are not limited to inkjet (e.g., thermal inkjet, piezo inkjet, etc.) and, dry laser toning print systems. In certain examples of in-line print systems using a printhead or printheads, calibration component 104 may cause a rewinding of a web substrate, or a reverse in the direction of feed of a sheet media, as applicable, with such rewinding or reverse to enable the printhead or printheads at the second print engine to print the calibration image upon the cover-up image.

In the foregoing discussion of FIG. 1, components 102-106 were described as combinations of hardware and programming. Components 102-106 may be implemented in a number of fashions. Looking at FIG. 2 the programming may be processor executable instructions stored on a tangible memory resource 230 and the hardware may include a processing resource 240 for executing those instructions. Thus memory resource 230 can be said to store program instructions that when executed by processing resource 240 implement system 100 of FIGS. 1 and 2.

Memory resource 230 represents generally any number of memory components capable of storing instructions that can be executed by processing resource 240. Memory resource 230 is non-transitory in the sense that it does not encompass a transitory signal but instead is made up of a memory component or memory components to store the relevant instructions. Memory resource 230 may be implemented in a single device or distributed across devices. Likewise, processing resource 240 represents any number of processors capable of executing instructions stored by memory resource 230. Processing resource 240 may be integrated in a single device or distributed across devices. Further, memory resource 230 may be fully or partially integrated in the same device as processing resource 240, or it may be separate but accessible to that device and processing resource 240.

In one example, the program instructions can be part of an installation package that when installed can be executed by processing resource 240 to implement system 100. In this case, memory resource 230 may be a portable medium such as a CD, DVD, or flash drive or a memory maintained by a server from which the installation package can be downloaded and installed. In another example, the program instructions may be part of an application or applications already installed. Here, memory resource 230 can include integrated memory such as a hard drive, solid state drive, or the like.

In FIG. 2, the executable program instructions stored in memory resource 230 are depicted as production module 202, calibration module 204, and adjustment module 206. Production module 202 represents program instructions that when executed by processing resource 240 may perform any of the functionalities described above in relation to production component 102 of FIG. 1. Calibration module 204 represents program instructions that when executed by processing resource 240 may perform any of the functionalities described above in relation to calibration component 104 of FIG. 1. Adjustment module 206 represents program instructions that when executed by processing resource 240 may perform any of the functionalities described above in relation to adjustment component 106 of FIG. 1.

FIGS. 3A-3D illustrate an example of in-line printing calibration. Starting at FIG. 3A, in this example of an in-line print system 100 a first print engine 302 prints a first image (represented as a field of dots) in a first set 308 of sectors (including S2, S4, and S6) of a substrate 310, and causes a second print engine 304 to print a second image (represented as diagonal lines) in a second set 308 of sectors (including S1 and S3) of the substrate. At the point of time represented in FIG. 3A, sector S5 is left blank (e.g., not printed upon by print engine one 302), as it is intended that in a production mode print engine two 304 would print the second image in sector S5.

Figure 3A:
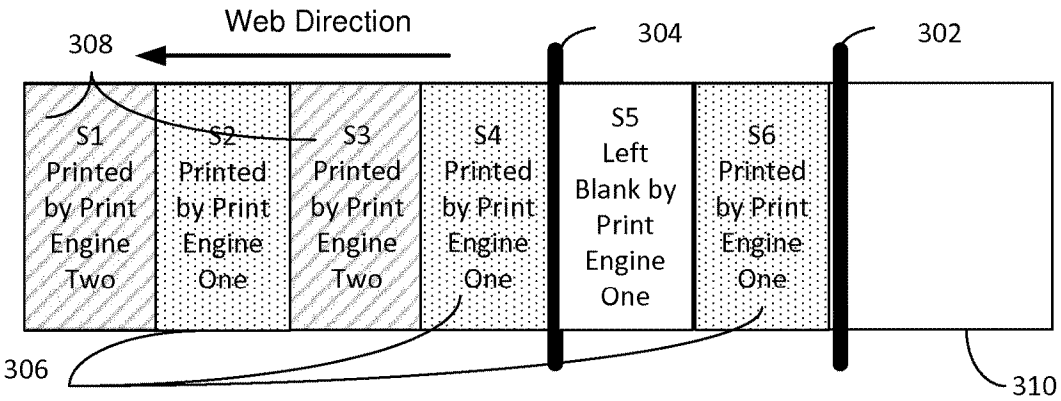
FIGS. 3A-3D illustrate an example of an in-line printing calibration.
Figure 3B:
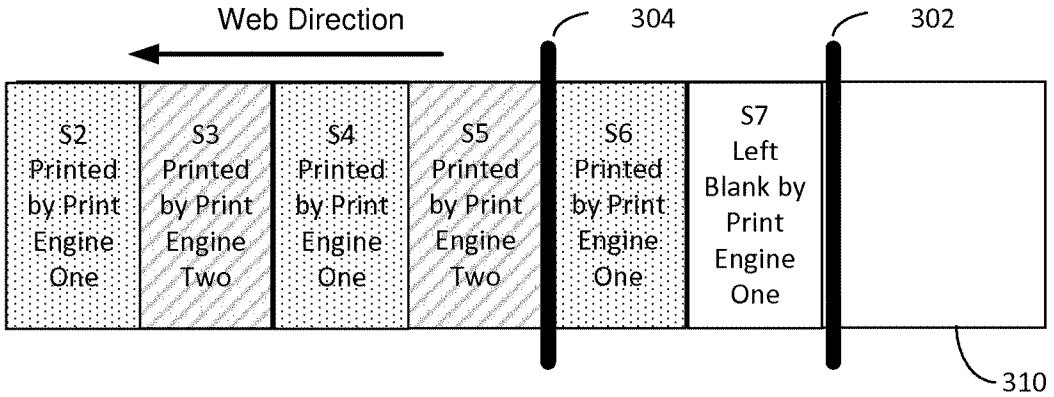

Moving to FIG. 3B, in this example system 100 determines that a calibration of the second engine is to occur or needed and that an incidence of the first image, printed upon sector S6 by print engine one 302, is situated between the engine one 302 and print engine two 304.

Figure 3C:
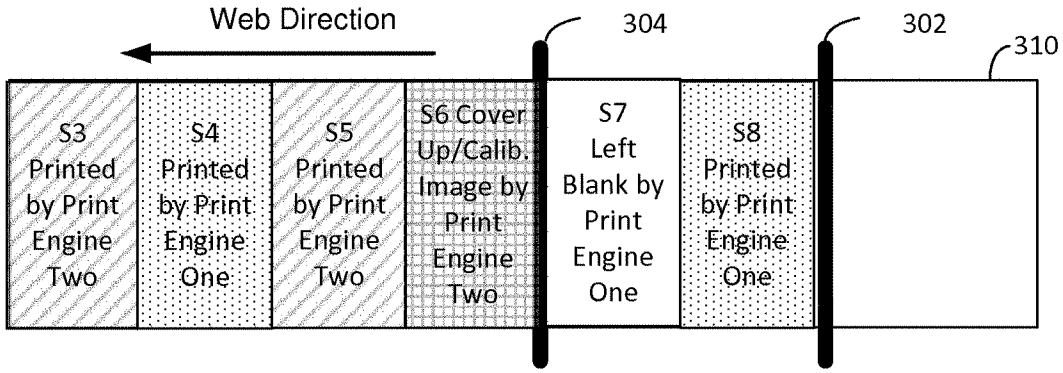
Figure 3D:
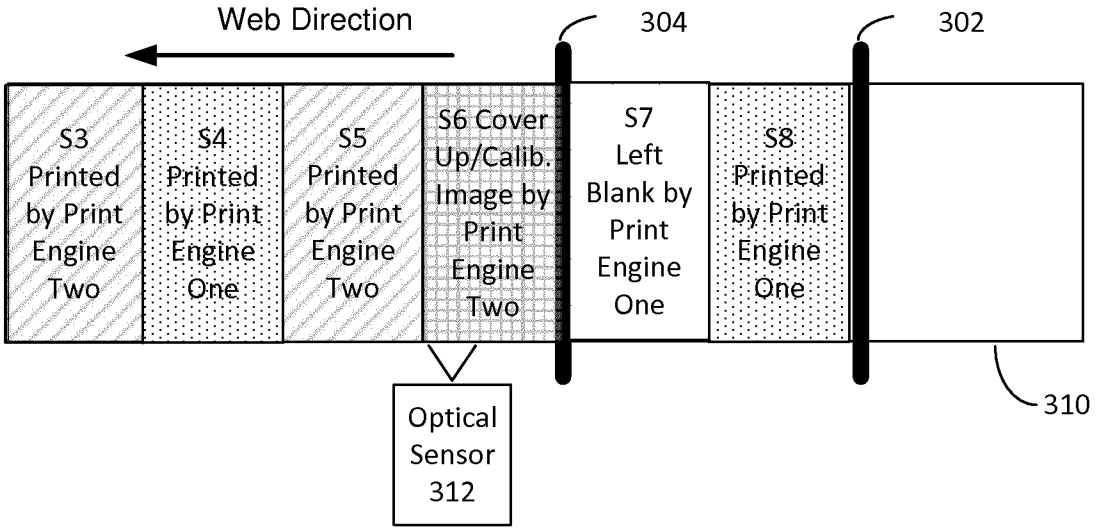

Moving to FIG. 3C, system 100 causes a calibration operation including print engine two 304 printing a cover-up image over an incidence of the first image that was printed by print engine one 302 at sector S6. Following print engine two 304 having printed of the cover-up image at sector S6, system 100 causes print engine two 304 to print at sector S6 a calibration image over the cover-up image. The calibration image printed over the cover-up image at sector S6 is represented by hash lines.

Figure 4:
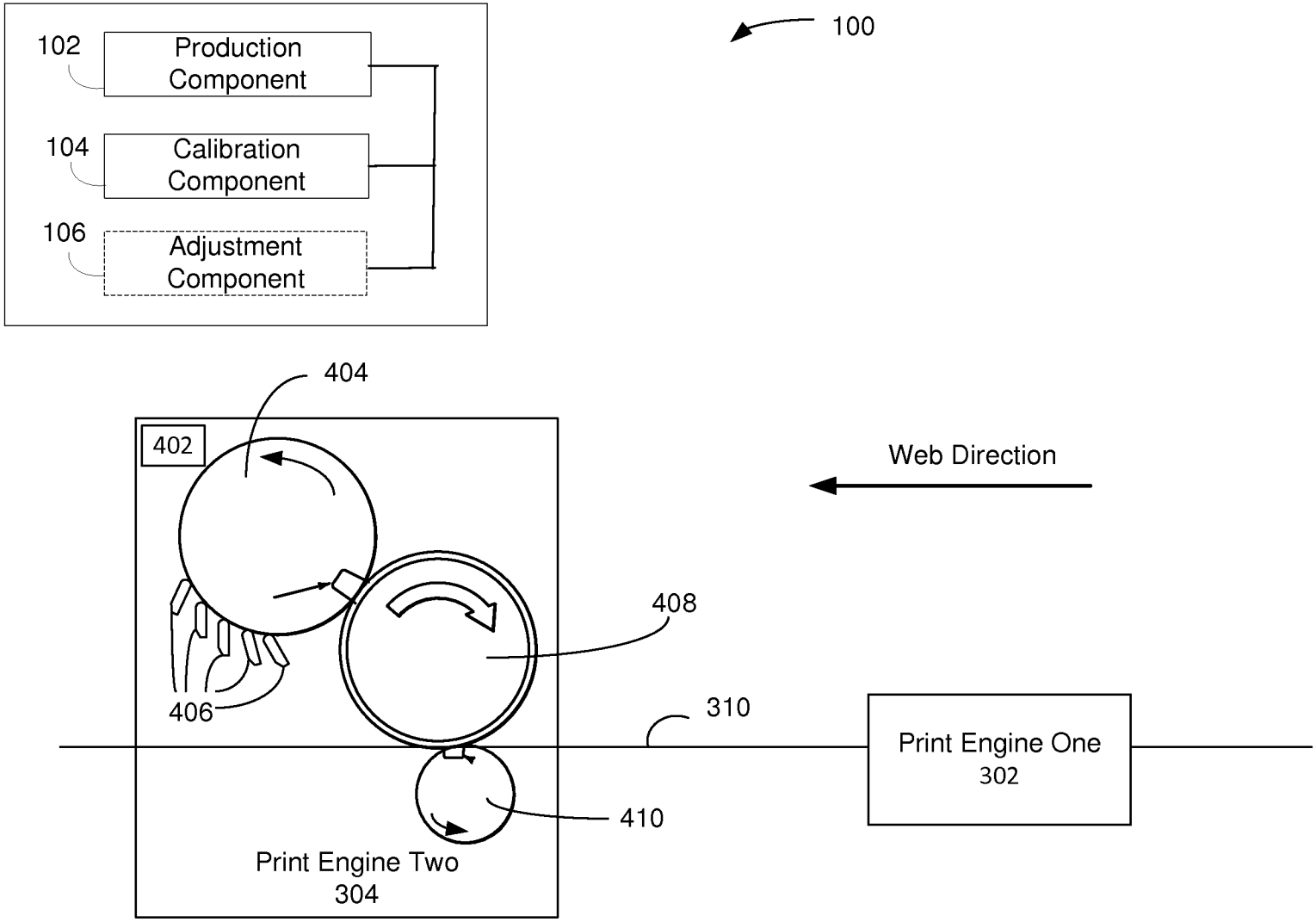
FIG. 4 illustrates an example of a system for in-line printing calibration with first and second print engines.

It should be noted that the disclosed system can, in numerous examples, allow for the calibration operation to occur in the midst of a production run without waste of substrate. In the example of FIG. 3C, for instance, system 100 may cause print engine two 304 to print the cover-up image and the calibration image at sector S6 of substrate 310, while print engine one concurrently prints the first image at sector S8 upstream of the first sectors Moving to FIG. 4, in examples where system 100 is an LEP print system, system 100 may cause printing of the second image in the second set of sectors (308, FIG. 3A) and the printing of the cover-up image and the calibration image over the cover-up image utilizing a writing element 402, a photoconductor element 404, developer units 406, a blanket 408, and an impression drum 410 for holding the substrate for transfer of ink (e.g., forming the second image, the cover-up image, or the calibration image) from the blanket 404 to the substrate 310. The writing element 402 may be a laser or other device for selectively discharging a photoconductor element 404 to form an image upon the photoconductor element. Developer units 404 are for applying electrostatic inks to photoconductor element 404 to create an inked version image, and photoconductor element 404 is to transfer the inked image to the blanket 408 Blanket 408 in turn transfers the inked image to the substrate 310 as the substrate is held or guided by the impression drum 410.

Figure 5A:
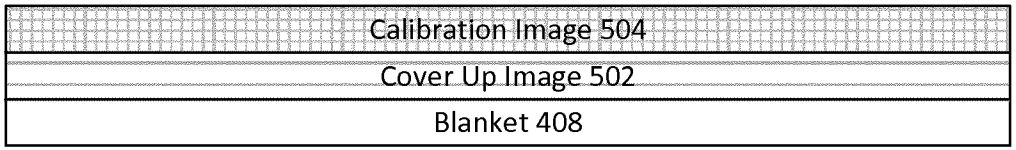
FIGS. 5A and 5B illustrate examples of transfer of a cover-up image as a first layer and a calibration image as a second layer to a blanket, and transfer of the first and second layers from the blanket to a substrate.
Figure 5B:
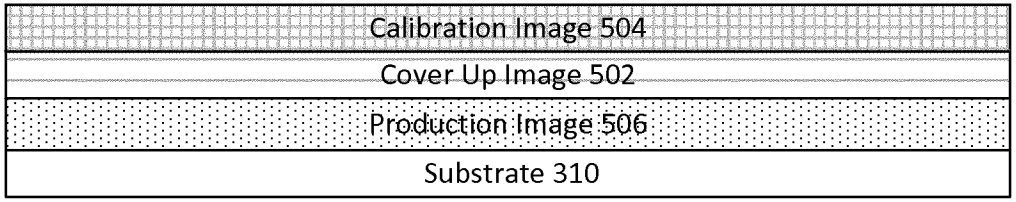

Moving to FIG. 5A, in an example of LEP printing, system 100 is to cause photoconductor element 404 (FIG. 4) to transfer the cover-up image 502 (represented by horizontal lines) as a first layer to the blanket 408, cause the photoconductor element 404 to transfer the calibration image 504 (represented by hash lines) as a second layer to the blanket 408. Moving to FIG. 5B, system 100 is to in turn cause the blanket 408 to make a concurrent transfer of the first layer (with the cover-up image 502) and the second layer (with the calibration image 504) to the substrate 310 to print over the production image 506 (that had been previously printed by print engine one 302 (FIG. 3A)) at sector S6.

Returning to FIG. 3D, after print engine two 304 prints the cover-up image and the calibration image over the production image printed by print engine one 302 at sector S6, system 100 causes an optical sensor 312 to identify the calibration image 504 (FIG. 5), and causes a calibration adjustment at the in-line print system based upon the such identification of the calibration image.

Figure 6:
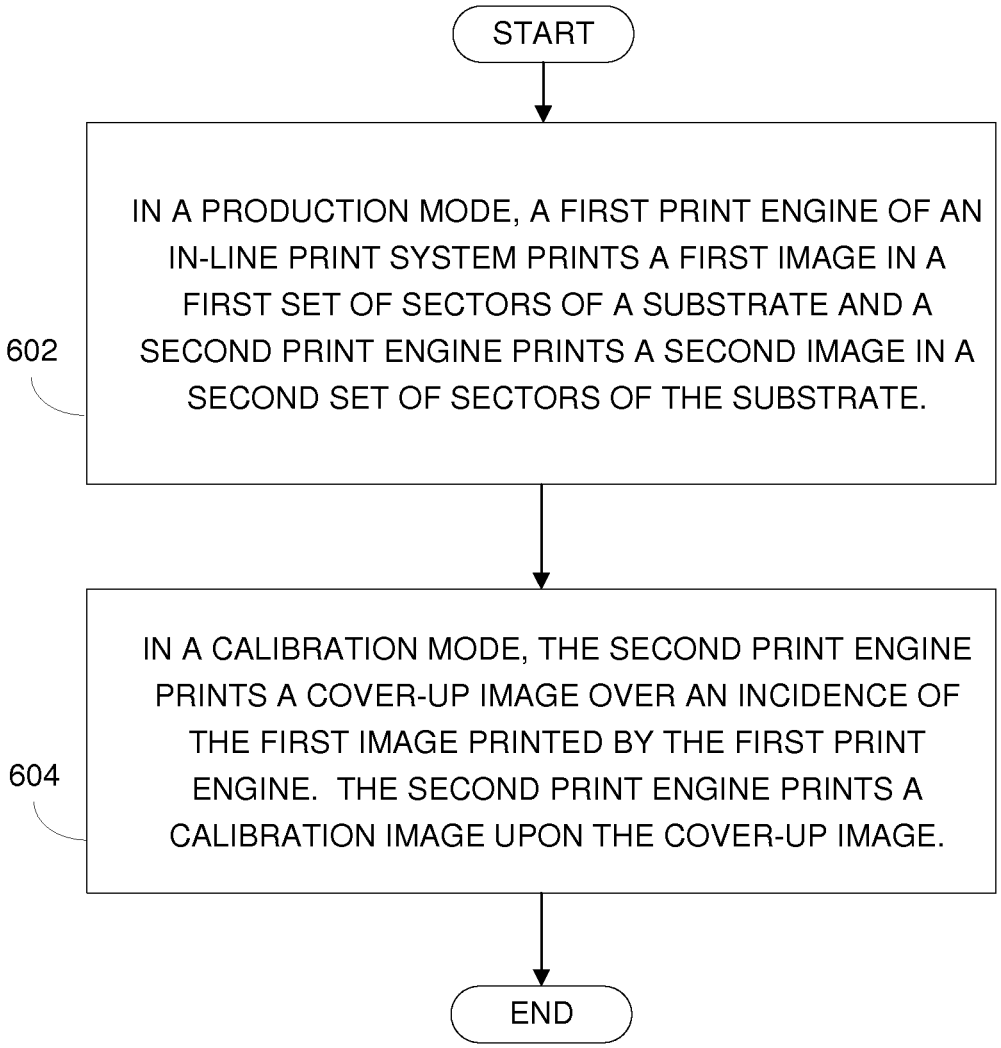
FIG. 6 is a flow diagram depicting implementation of an example of a method of in-line printing calibration.

FIG. 6 is a flow diagram of implementation of a method for in-line printer calibration. In discussing FIG. 6, reference may be made to the components depicted in FIGS. 1 and 2. Such reference is made to provide contextual examples and not to limit the manner in which the method depicted by FIG. 6 may be implemented. In a production mode, a first print engine of an in-line print system prints a first image in a first set of sectors of a substrate and a second print engine prints a second image in a second set of sectors of the substrate (block 602). Referring back to FIGS. 1 and 2, production component 102 (FIG. 1) or production module 202 (FIG. 2), when executed by processing resource 240, may be responsible for implementing block 602.

In a calibration mode, the second print engine prints a cover-up image over an incidence of the first image printed by the first print engine. The second print engine prints a calibration image upon the cover-up image (block 604). Referring back to FIGS. 1 and 2, calibration component 104 (FIG. 1) or calibration module 204 (FIG. 2), when executed by processing resource 240, may be responsible for implementing block 604.

FIGS. 1, 2, 3A-3D, 4, 5A, 5B, and 6 aid in depicting the architecture, functionality, and operation of various examples. In particular, FIGS. 1 and 2 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function(s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 6 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. An in-line print system, comprising:

a production component to cause a first print engine to print a first image in a first set of sectors of a substrate, and to cause a second print engine to print a second image in a second set of sectors of the substrate; and a calibration component to cause the second print engine to print a cover-up image over an incidence of the first image printed by the first print engine; and cause the second print engine to print a calibration image upon the cover-up image.

2. The in-line print system of claim 1, further comprising an adjustment component to cause a calibration adjustment at the in-line print system based upon an identification of the calibration image.

3. The in-line print system of claim 2, wherein the calibration component causes the second print engine to print the cover-up pattern with an optical density sufficient to enable an optical scanner to identify the calibration image.

4. The in-line print system of claim 1, wherein the production component is to cause the first print engine to print incidences of the first image and the second print engine to print incidences of the second image such that after printing the substrate includes a printed row of alternating first and second images.

5. The in-line print system of claim 1, wherein the calibration component is to cause the second print engine to print the cover-up image and the calibration image based upon a determination that a portion of the substrate situated between the first and second print engines has been printed upon by the first print engine.

6. The in-line print system of claim 1, wherein the second print engine prints the cover-up image and the calibration image at a first sector of substrate, and the first print engine is to concurrently print the first image at a second sector of the substrate upstream of the first sector.

7. The in-line print system of claim 1, wherein the second print engine includes a photoconductor element and a blanket to receive images from the photoconductor element;

wherein the second print engine is to cause the photoconductor element to transfer to the cover-up image as a first layer to the blanket, and is to cause the photoconductor element to transfer the calibration image as a second layer to the blanket, and is to cause the blanket to make a concurrent transfer of the first and second layers to the substrate.

8. The in-line print system of claim 1, wherein the calibration component is to determine that n iterations of the cover up image are to be applied upon the substrate, and wherein the calibration component is to cause the n iterations of the cover-up image to be applied upon the substrate.

9. The in-line print system of claim 1, wherein the second print engine includes an inkjet printhead, and wherein the calibration component is to cause a rewinding of the web substrate, the rewinding to enable the second print engine to print the calibration image upon the cover-up image.

10. A memory resource storing instructions that when executed are to cause a processing resource to enable in-line printing calibration, comprising:

a production module that when executed causes a first print engine to print a first image in a first set of sectors of a substrate, and causes a second print engine to print a second image in a second set of sectors of the substrate;

a calibration module that when executed causes a calibration operation including the second print engine printing a cover-up image over an incidence of the first image printed by the first print engine, and the second print engine printing a calibration image upon the cover-up image; and an adjustment module that when executed causes a sensor to identify the calibration image, and causes a calibration adjustment at the in-line print system based upon the sensor identification.

11. The memory resource of claim 10, wherein the calibration adjustment is to a registration system that measures an actual location or scaling of an image relative to a desired location or scaling.

12. The memory resource of claim 11, wherein the desired location or the desired scaling is upon one of a photoconductor drum, a blanket, and a substrate.

13. The memory resource of claim 10, wherein the calibration adjustment is to a substrate position measurement system.

14. The memory resource of claim 10, wherein the calibration adjustment is to a system that is to measure one of a pressure, a relative location, and a timing of engagement as between a developer unit and a photoconductor element, as between a photoconductor element and a blanket, or as between a blanket and a substrate.

15. An in-line printing calibration method, comprising:

causing a first print engine to print a first image in a first set of sectors of a substrate;

causing a second print engine to print a second image in a second set of sectors of the substrate; and causing the second print engine to utilize a photoconductor element to transfer a cover-up image as a first layer to a blanket, and transfer a calibration image as a second layer to the blanket, and to cause the blanket to concurrently transfer the first and second layers to the substrate to print over an incidence of the first image.

* * * * *